US008020329B2

(12) United States Patent
Chavez

(10) Patent No.: US 8,020,329 B2
(45) Date of Patent: Sep. 20, 2011

(54) VERSATILE DECORATIVE OBJECT, NAMED THE PAIRED IMAGE PRINT, HAVING A UNIQUE VISUAL EFFECT AND A METHOD OF MAKING SAID VERSATILE DECORATIVE OBJECT

(76) Inventor: Yvonne Marie Chavez, Nederland, CO (US)

( * ) Notice: Subject to any disclaimer, the term of this patent is extended or adjusted under 35 U.S.C. 154(b) by 1698 days.

(21) Appl. No.: 11/022,225

(22) Filed: Dec. 22, 2004

(65) Prior Publication Data

US 2005/0134035 A1 Jun. 23, 2005

Related U.S. Application Data

(60) Provisional application No. 60/532,680, filed on Dec. 23, 2003.

(51) Int. Cl.
*G09F 19/00* (2006.01)

(52) U.S. Cl. ..... 40/615; 434/269

(58) Field of Classification Search ..... 40/615, 40/427, 442, 443; 434/269
See application file for complete search history.

(56) References Cited

U.S. PATENT DOCUMENTS 3,815,979 A 6/1974 Collender
3,997,991 A * 12/1976 Hayman-Chaffey et al. ... 40/361
4,116,526 A 9/1978 Clay
4,206,965 A 6/1980 McGrew
4,834,476 A 5/1989 Benton
5,050,961 A 9/1991 Venola
5,181,745 A * 1/1993 Jacobsen et al. ..... 283/94
5,398,131 A 3/1995 Hall
5,609,938 A * 3/1997 Shields ..... 428/138
6,559,983 B2 5/2003 Toyoda et al.
6,710,900 B1 3/2004 Klug
6,739,368 B2 5/2004 Shirakura
6,778,295 B1 8/2004 Babulski
6,844,948 B2 1/2005 Lieberman
6,976,915 B2 * 12/2005 Baker et al. ..... 463/1
2007/0124970 A1 * 6/2007 Hjaltason ..... 40/546

* cited by examiner

*Primary Examiner* — Cassandra Davis
(74) *Attorney, Agent, or Firm* — Yvonne M. Chavez

(57) ABSTRACT

A versatile decorative object having a multidimensional visual effect with a first layer separated from a second layer. The first layer is opaque and has applied on it a decorative image having at least black and white and the second layer (s) is transparent and has applied on it the same decorative image with the white of the image being transparent on the second layer. A preferred embodiment includes the first layer and the second layer(s) to be digitally created to accomplish the removal of white space from the decorative image. During this digital creation, proportions, size, juxtaposition of layers and content of the image is critical in achieving the stated visual effect.

17 Claims, 5 Drawing Sheets

VERSATILE DECORATIVE OBJECT, NAMED THE PAIRED IMAGE PRINT, HAVING A UNIQUE VISUAL EFFECT AND A METHOD OF MAKING SAID VERSATILE DECORATIVE OBJECT

CROSS REFERENCE TO RELATED APPLICATIONS

This application is based on provisional application Ser. No. 60/532,680, filed on Dec. 23, 2003.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of holographic image effects and more specifically to a process for achieving a versatile decorative object with a unique visual effect.

It can be appreciated that images have been adjusted to give the illusion of multi-dimension and depth in the past several years. Consistent with the development of analog and digital photography a desire to create life-like images emerged. Thus, various techniques have been developed to produce multi-dimensional illusions. Three common types of images containing properties of visual illusion are: 1) holographic images 2) 3-D images and 3) a stereogram image. The stated types of images have been used to give visual interest and appeal to motion film, advertisements, and photographs. Multi-dimensional images have aided our understanding of color, light, and depth perception.

A hologram image is made for example by using one or more images as the base image obtained from an object that has been recorded in sequence from different viewing points using rectangular or dot shaped hologram elements on one hologram recording medium. In the stereogram, the capturing of sequential images from laterally different view points places different pieces of two dimensional information are seen respectively by the right eye and the left eye when the person views the stereogram with both eyes. The person perceives a visual difference in angle creating a three dimensional illusion of the image to the eye.

Stereograms are produced by taking two photographs of the same field of view from the perspective of the right human eye and then the perspective of the left human eye, and then displaying them separately to the eyes of the observer using a special apparatus.

Additional holographic stereograms are on the market as variations of the hologram and the stereogram and are produced using complex light refraction and reflection techniques applied to special transparent materials for printing that contain inherent light reflective properties when ink or toner is applied. The transparent material is printed upon and functions as a spacer or separating mechanism from one layer to the next as each layer is stacked upon the next layer whereas each is aligned with a perpendicular relationship. The onlooker then sees a holographic stereogram when exposed to light at various intensities depending upon the relationship between the layers, the angle of the image to the exposure source (light), and the color content of the image.

Three dimensional (3-D) images are produced using complex color separations relating to juxtaposition of content within the base image. The onlooker must then use special glasses to "translate" the image and trick the brain into seeing three dimensions.

Another 3-D image is produced as a "multiplex hologram" wherein the hologram is generates a vertically focused, horizontal parallax hologram composed of many small areas such that the hologram is a composite of three-color component holograms. A complex color matching system works with an array of color filters to produce a full color hologram on one surface.

The main problem with 3-D images is that when a person views the image he or she must wear special viewing glasses to see the three dimensional illusion. Another problem is that in the case where special viewing glasses are not required, the 3-D image cannot be viewed as one single image free of the illusion if the onlooker so desires. Further problems with the 3-D image, is that the illusion is complex and expensive to produce.

The main problem with holographic images is again the complexity of producing the image because a laser must be used to create the hologram. Another problem with the hologram is that resolution of the image is sacrificed in the production method due to regeneration and or manipulation of the same image or sets of images. Further problems with the holographic image include: a lack of versatility for multiple end-uses, a limitation in construction materials, and a high expense for creating the visual illusion. Some images such as black and white photographs, line drawings, or screen prints, cannot be produced to give the visual illusion as a stereogram or hologram or 3-D image.

In some variations of the hologram it can be appreciated that high volume production at a low cost is achieved, however, the end use for the hologram is limited. For example, the multiplex hologram uses complex light refraction, reflection, and color filters to produce the visual effect limiting the application of the hologram. Another problem is that even the most versatile holograms are recorded on a heat sensitive media so that the hologram is fragile under certain light and heat exposures which can limit the practical use of holograms on physical objects such as but not limited to coffee mugs, and t-shirts.

BRIEF SUMMARY OF THE INVENTION

The primary object of the invention is to provide decorative objects having multidimensional effects that can be easily manufactured using processes that are less expensive and less complex than previously known methods of making such objects. The decorative objects of the present invention have the advantages of low cost manufacturing and versatile application methods to produce a variety of end products using a variety of materials appropriated to the end product based upon durability, aesthetic appeal, and functionality. For example if the invention is to be applied to a t-shirt, then the construction method allows for adjustment to use cloth or natural fabric instead of paper or plastic that would be the optimum choice for use on a greeting card or poster.

Another object of the invention is to provide decorative objects having multidimensional effects where such effects can be perceived without additional glasses, props, or tools.

An additional object of the invention is to provide a method of making decorative objects having multidimensional effects where such method is simple and low cost.

Often even the best digitally produced image contains an apparent pixelization in the final print process, thus decreasing the visual appeal and clarity of the digital image. Another object of the invention is to minimize the pixelation of the digital image while maximizing the clarity and visual integrity of the image through a process called de-pixelization to further increase the realistic look of the image. The de-pixelization advantage will be described subsequently in greater detail.

A further object of the invention is to provide the onlooker with the option of viewing the image as a flat image free of the visual effect. Yet another object of the invention is to provide a unique, eye catching visual effect that is dynamic with depth in relation to onlooker's distance from the image. Still yet another object of the invention is to add depth, dimension, and visual interest and appeal to any image that can be digitized.

Another object of the invention is to provide a decorative object that can be produced by a person with moderate skill in the art using simple production methods that utilize a commonly available home computer. Yet another object of the invention is to cross the complex color separation, light filter, color filter, and reflection and refraction barriers by providing a method that allows black and white images to be produced with the stated visual effect.

Other objects and advantages of the present invention will become apparent from the following descriptions and the accompanying drawings.

In accordance with a preferred embodiment of the invention, there is disclosed a versatile decorative object with a multidimensional visual effect (illusion) comprising a first opaque image layer separated from a second transparent image layer (s) wherein the first layer is opaque and has applied on it a decorative image having at least black and white and wherein the second layer is transparent and has applied on it the same decorative image with the white of the image being transparent on the second layer.

The invention further includes methods to produce a variety of end products using a variety of materials appropriated to the end product based upon durability, aesthetic appeal, and functionality of the said invention though the following: digitally created image layers, additional transparent image layers differing in level of opacity, color composition, and/or color separations, spacer placed between said first and second layer (s), and juxtaposition of the said opaque image layer and said transparent image layer(s).

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. <1> is a perspective view of the invention.
FIG. <2> is a perspective view of the invention.
FIG. <3> is a perspective view of the invention.
FIG. <4> is a perspective view of the invention.
FIG. <5> is a perspective view of the invention.
FIG. <6> is a perspective view of the invention.

DETAILED DESCRIPTION OF THE PREFERRED EMBODIMENTS

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
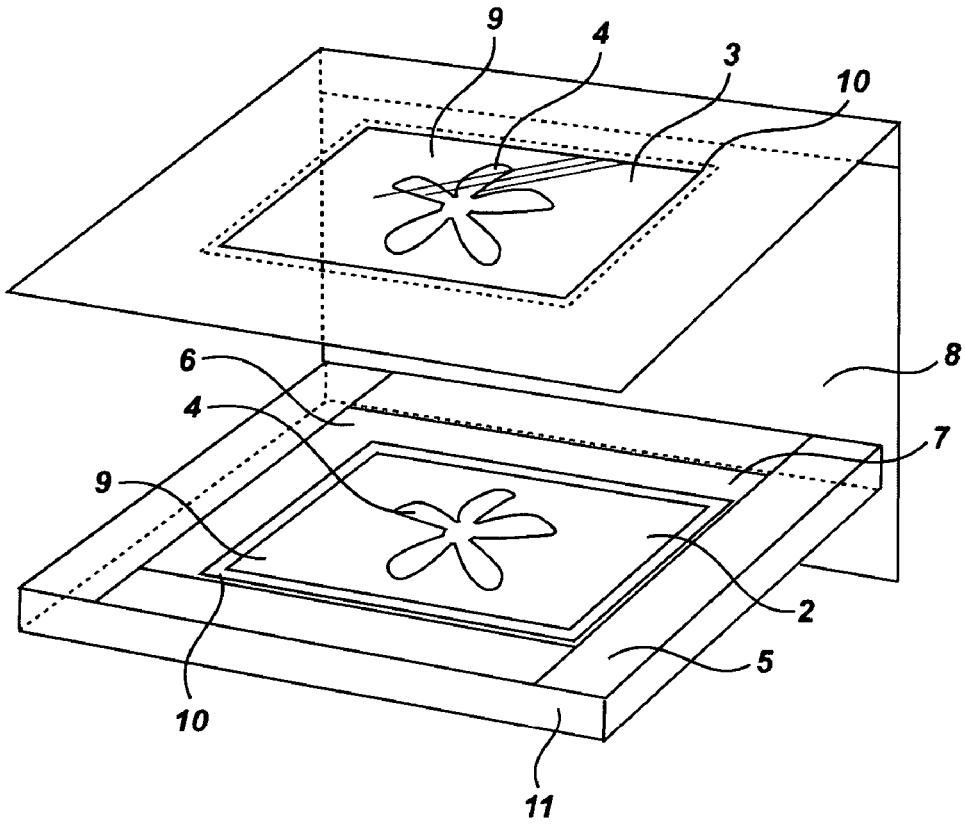

The versatile decorative object 1 of the invention as shown in FIG. 1 comprises a first layer 2 separated from a second layer 3 wherein the first layer 2 is opaque and has applied on it a decorative image 4 having at least black and white and wherein the second layer 3 is transparent and has applied on it the same decorative image 4 with the white of the image being transparent on the second layer 3. Decorative image 4 on first layer 2 and decorative image 4 on second layer 3 are termed the same image in respect to the invention but each image can be distorted either in color, contrast, saturation, or dimensional distortion or a combination therein while still remaining the same decorative image 4. Thus, the same decorative image 4 that is applied to first layer 2 and second layer 3 may be modified differently as applied to each of said layers but is referred to herein as the same image because the same original image is used as the starting point before modifications are made for application to the first and second layers 2 and 3.

As shown in FIG. 1, the second layer 3 is juxtaposed over the first layer 2 so that decorative images 4 on each of the two layers are in approximate alignment. The first layer 2 is in relationship to the second layer 3 wherein the first layer 2 to the second layer 3 registration lines up the image data at no greater than ½" and no less than 0" horizontal alignment from said first layer 2 decorative image 4 and second layer 3 decorative image 4.

Further, the decorative image 4 applied to the first layer 2 and second layer 3 includes at least one color. Preferably, decorative image 4 applied to second layer 3 has a color composition, opacity, contrast, color saturation and/or dimensional distortion different than the same decorative image 4 as applied to first layer 2.

In a preferred embodiment of the invention, the decorative image 4 applied to the first layer 2 is no more than 25% larger or 25% smaller than the same image applied to the second layer 3. The decorative image 4 applied to the second layer 3 may be applied at a lower quality image than is applied to the first layer 2. In a preferred embodiment of the invention, decorative image 4 applied to the first and second layers 2 and 3 is digitally created.

Figure 4:
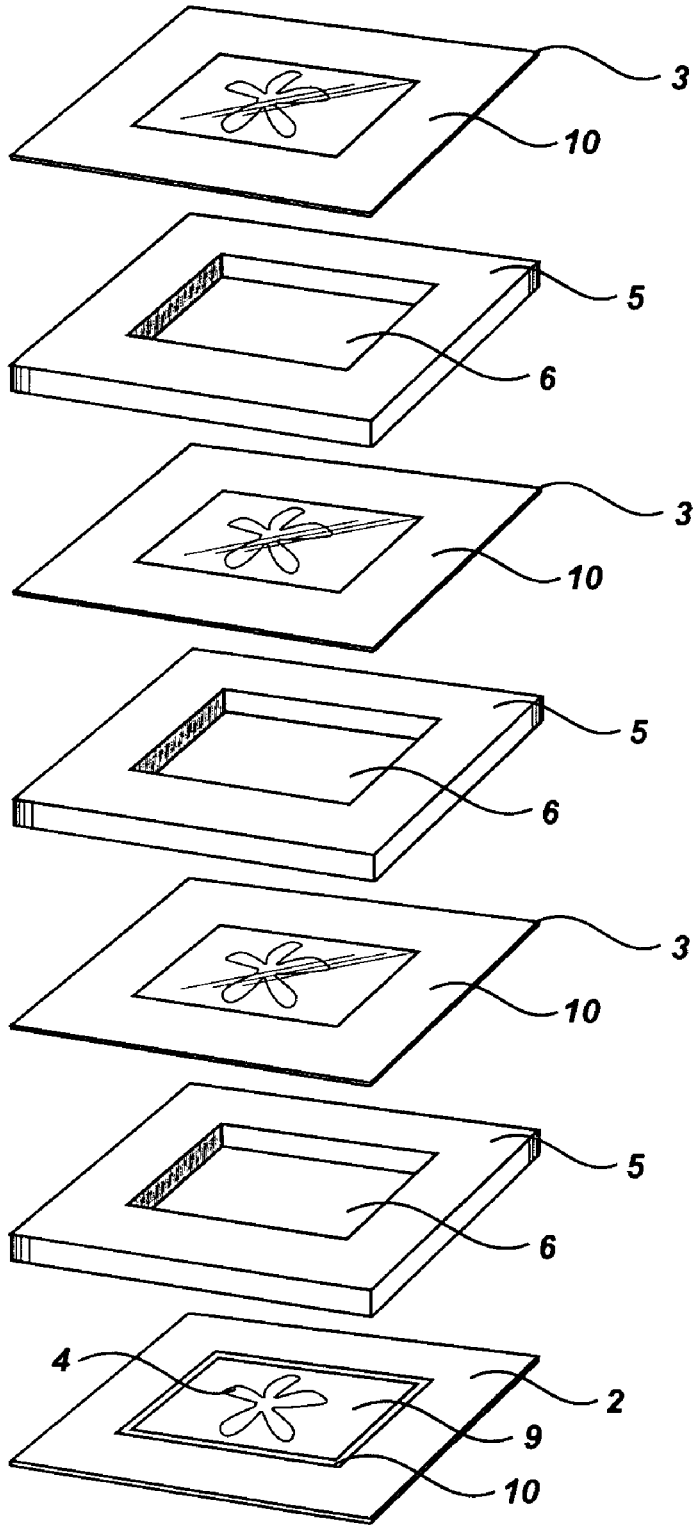

The invention may include a means to separate the first layer 2 from the second layer 3. As shown in FIG. 4, the means to separate first layer 2 and second layer 3 may comprise an the spacer 5 that is one solid piece with an aperture 6 in the center sized to match the size of decorative image 4.

Figure 6:
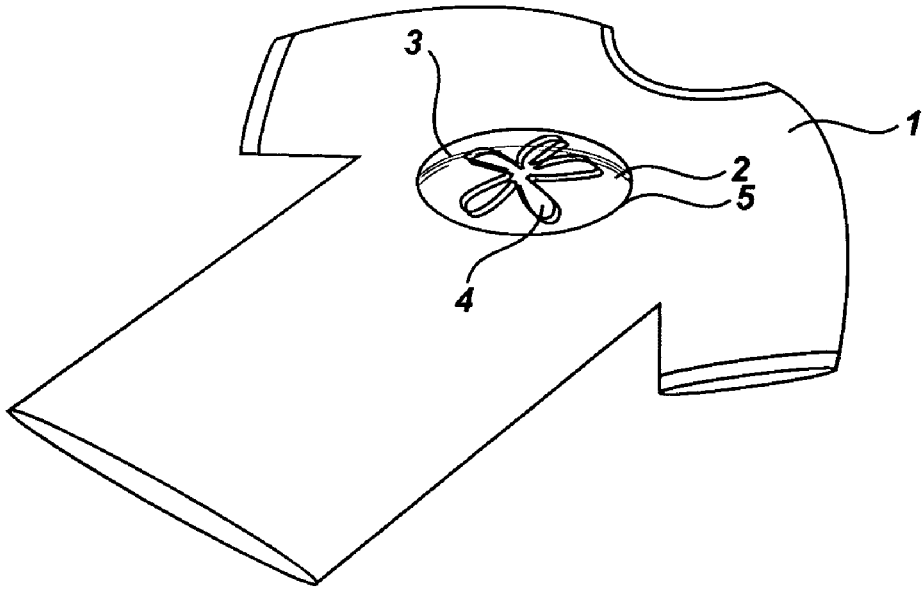

Alternatively, as shown in FIG. 6, the means to separate first layer 2 and second layer 3 may be the placement of second layer 3 in a convex relationship to first layer 2 or vice versa.

As shown in FIG. 1, the means for separating first layer 2 from second layer 3 may also be a rigid object 8 (?) placed between first layer 2 and second layer 3. The means for separating first layer 2 from second layer 3 may also comprise embedding either or both of said layers in a substantially clear solid medium such as acrylic so that the substantially clear solid medium provides sufficient separation to accomplish the desired multidimentional visual effect.

Preferably, the means for separating first layer 2 and second layer 3 separates said layers by no greater than 3" and no less than 1/32".

The present invention may include multiple transparent layers. FIG. 4 shows additional transparent second layers 3 separated from first layer 2 and second layer 3. Additional transparent layers 3 and 3 have the same decorative image 4 applied to them wherein said decorative image 4 has at least black and transparent space on each of said additional layers. As is apparent without being shown in the Figures, multiple transparent layers in addition to additional transparent layers 3 may be added to further enhance the visual effects of the invention.

Each additional transparent layer, including additional transparent layers 3 shown in FIG. 4, has applied to it the same decorative image 4 as applied to first layer 2 and second layer 3. Preferably, decorative image 4 as applied to each of the additional transparent layers differs in levels of opacity, color composition, dimensional distortion, and/or color separation. Each additional transparent layer is separated from each other and from second layer 3 by the same means as previously discussed for separating first layer 2 from second layer 3.

The present invention, as shown in FIG. 1 may further comprise a rigid frame back 7 and a rigid frame front 8.

Decorative objects embodying the present invention can be constructed from many different combinations of first layer 2, second layer 3, additional transparent layers 3 and separation means, rigid frame front 8, and rigid frame back 7 elements. Each of these elements can be comprised of one or more individual sub-components. Several of these embodiments are described in the following examples, without limiting other possible combinations. In these examples the primary elements as the first layer 2 and second layer 3 are principally constant while the secondary elements of spacer 5, rigid frame front 8 and rigid frame back 7, and same decorative image 4, are varied.

Figure 2:
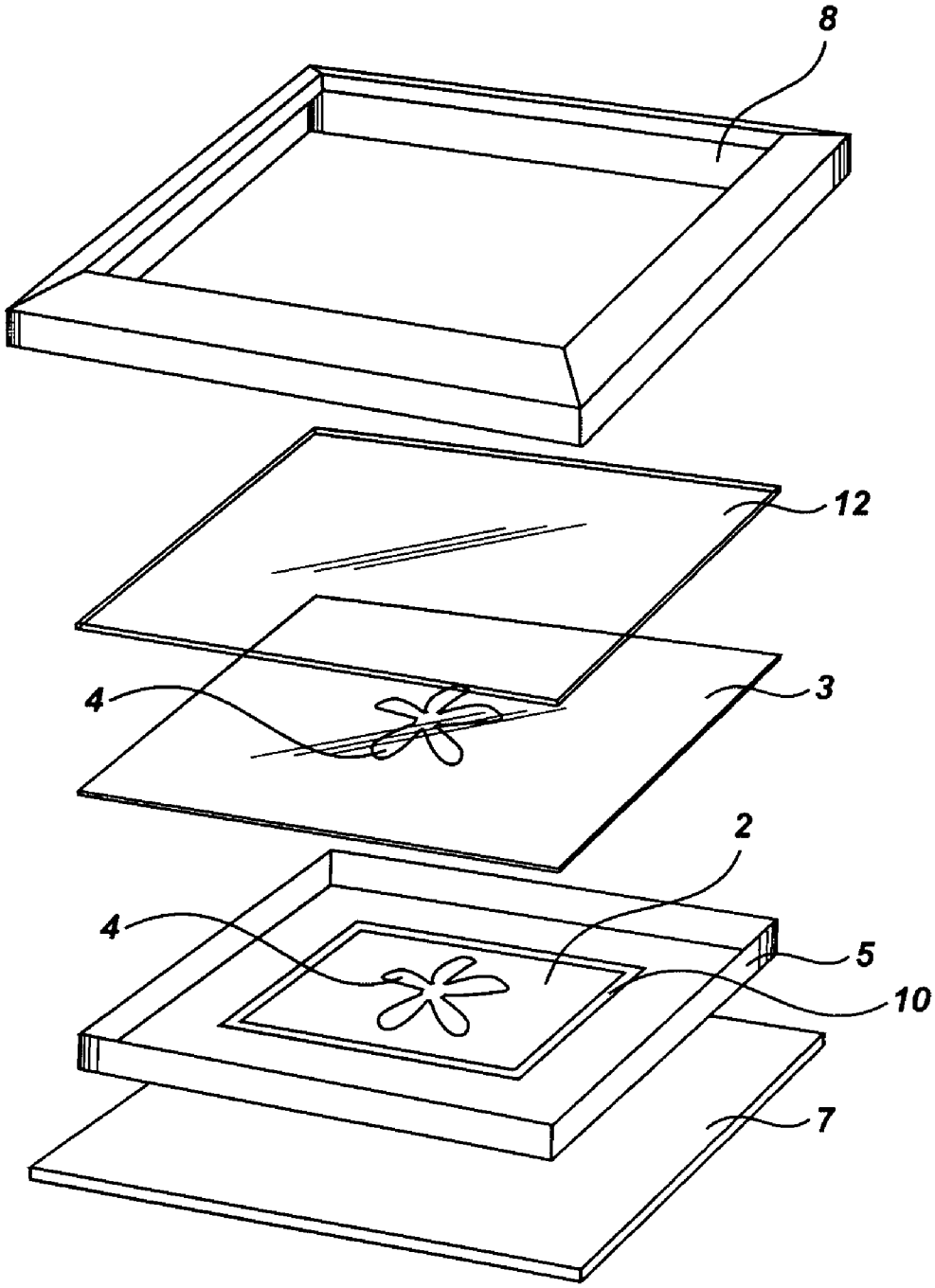
Figure 5:
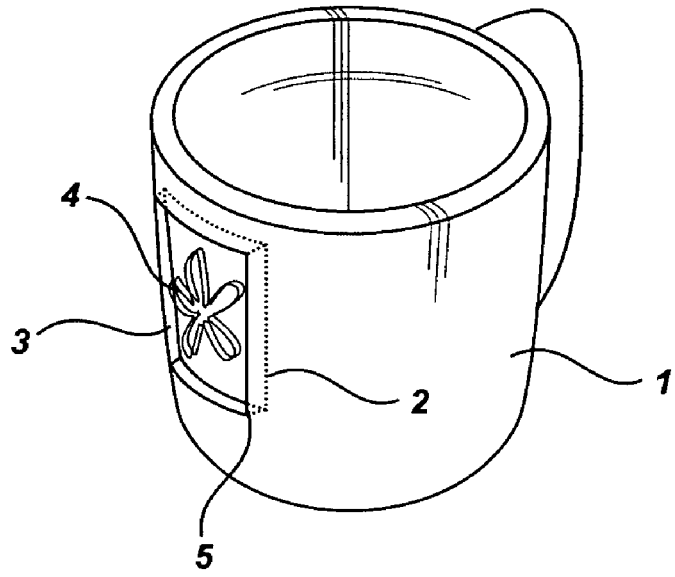

For example, the decorative object of the invention may be a Poster as shown in FIG. 2, a Greeting Card as shown in FIG. 1, a Coffee Mug as shown in FIG. 5 and/or T-Shirt as shown in FIG. 6. The best mode of construction for a Poster as shown in FIG. 2 and a Greeting Card as shown in FIG. 1 is to compose decorative image 4 using digital image techniques as described below:

The method for creating the decorative object of the present invention will be obvious from the descriptions herein. Said method comprises the steps of creating decorative image 4, applying decorative image 4 to first layer 2 and second layer 3, and providing a means for separating first layer 2 from second layer 3. Preferably, decorative image 4 as applied to first layer 2 differs with respect to color composition, opacity, contrast, color saturation and/or dimensional distortion as the same decorative image applied to second layer 3 and any additional layers 2 and 3.

The best method of construction is first to create decorative image 4 using a computer software program for digital imaging and editing. Decorative Image 4 may be made by starting from an original image derived from a painting, a photograph, a digital photograph, a computer generated graphic, and/or drawing. If the original image is not yet a digital image, standard digitizing equipment such as a scanner or digital camera may be used to translate the non-digital image to a digital image. This procedure for converting a non-digital image to a digital image is conventionally known as "digitizing."

Once the original image has been digitized, the process of transforming the original image into decorative image 4 to be applied to first layer 2 begins by considering the finished size in height and width of the decorative object. Referring to FIG. 1 in the drawings, the finished size of the decorative object 1 sets the rigid frame back 7 and the rigid frame front 8 size which in turn sets the first layer 2 image size, the inner layer mat 10 size, and finally the second layer(s) 3 size, ultimately communicating a proportional dependence of size between the layers.

Since a proportional dependence between the layers exists, it is best to begin constructing decorative image 4 by creating the first layer 2 in proportion to the rigid frame back 7 which is equal to the rigid frame front 8. As shown in FIG. 1, the rigid frame front 8 folds over the spacer 5 and is eventually upon completion affixed to the spacer 5.

The finished size of decorative object 1 may increase or decrease without affecting the overall end product as long as the proportions are kept intact as stated herein. The finished print size determination is significant in the digital imaging process as it defines the dots per inch assignment of decorative image 4 as applied to first layer 2. The significance of the dots per inch assignment will be explained further in the description of formatting decorative image 4 for application to first layer 2. Additional explanation of the significance of the dots per inch assignment will be explained in the description for making the decorative image 4 for application to second layer 3.

In this example, the first layer 2 is comprised of two parts: the image 9 and the canvas 10 as shown in FIG. 1. The canvas 10 represents the medium on which the image will be applied for end use. The image 9 is the viewable digital impression of the original non-digital image as described here within. The image 9 size is set proportionally smaller than the canvas 10 size as shown in FIG. 1. The purpose of the canvas 10 is to supply an area to attach the first layer 2 image to the inner layer mat 10 as the said spacer 5, which will be further explained in the inner layer mat 10 as the spacer 5 component description. The canvas 10 may or may not be visible in the final form of the decorative object 1 as the present invention. The best model for determining the dependent size relationship between the first layer 2 image components and spacer 5 components as the inner layer mat 5 is outlined in the mathematical equation below:

$$(x \leqq 1/8''y)+(z \geqq 1/8'')=a$$

Key:

x represents the value of the image size 9.

y represents the value of the inner layer mat 5 aperture 6 size.

z represents the value of the canvas 10 size.

a represents the first layer 2 image size.

Once calculated, the canvas 10 size added to the image size preferably should not exceed the inner layer mat 5 size. If the image size is in excess of 20"×30" in height and width the dots per inch assigned should exceed 300 dots per inch as is standard practice in the digital imaging art. A direct relationship exists between the dots per inch assignment and image clarity once the image is applied to paper by a printer. Thus, if the practitioner desires a high quality image with supreme clarity, the dots per inch assignment would increase as the desired clarity increases. For example, if the total inner layer mat 5 aperture is 4"×5", then the image size of the first layer image is sized at 4"×5". Using this same example, the inner layer mat 5 now has a 1" space surround for the canvas 10 size to affix to. The canvas 10 size in this example is up to 1" around the image 9 size.

After formatting the image 9 size and canvas 10 size for print production as set forth, the merging of the image 9 and canvas 10 creates the first layer 2 image as shown in FIG. 1. The first layer 2 image is enhanced using a computer software program for digital image editing.

The enhancement of the first layer 2 image starts by digitally optimizing the first layer 2 image for color clarity. In reference to the present invention as the decorative object 1, color clarity refers to the comprised make-up of at least black and white colors but preferably includes highly chromatic colors, black, and white.

Using a digital imaging and editing software program, the best composition is created to consist of varied and scattered parts of black, white, and highly chromatic colors. Minimizing or maximizing the content of each part will minimize or maximize the strength of the stated visual effect. For example, if a digital photograph is comprised of 1 Hue: Blue with no varying values of the Blue Hue and only 3% white space, the visual effect will be slight. Highly Chromatic colors and black will come forward to the eye when looking upon the present invention which aides in the visual depth effect of the decorative object 1 as the present invention. Conversely, white and grey will recess to the eye once the decorative object 1 as the present invention is completed for end use. Adjusting the image using a computer software program for digital imaging and editing to contain a varied amount of highly chromatic colors is a standard practice by any person skilled in color theory and graphic arts. For example, using such tools as levels, contrast, hue, saturation, cut, paste, masking, and other such manipulation tools, once can achieve a 33% white space, a 33% black space, and a 33% highly chromatic color space all in one digital image.

Now that the first layer 2 has been sized, formatted for print, and enhanced for color clarity according to the guidelines set forth, the first layer 2 image is printed (applied) onto an opaque surface having an opacity of 50% to 100% such as photo paper or ink jet paper which is conventional in the digital imaging art. The first layer 2 image is the printed at the best possible saturation quality of the output device such as an ink jet printer or photocopy machine.

The first layer 2 image is then mounted onto the inner layer mat 5 as shown in FIG. 1 and alternatively in FIG. 2 using an adhesive such as double stick tape or spray mount glue. As shown in FIG. 1, the first layer 2 image 9 is to be placed so that the entire first layer 2 image 9 completely fills the aperture within the inner layer mat 5. The inner layer mat's 5 visible depth 11 must be retained as shown in FIG. 1. The inner mat 5 functions as a spacer 5 component between the first layer 2 and the second layer 3 (s) to keep each stated layer physically separated from one another as shown in FIG. 1. A detailed explanation of the spacer 5 component and its properties are explained in the following section:

The optimum depth 11 of the spacer 5 is to be constructed at ¼" in depth. The height and width of the spacer 5 is constructed proportionally to the height and width of the first layer 2. The purpose of the spacer 5 is to provide a physical separation between the first layer 2 and the second layer 3(s) at a total preferred depth of ¼". The depth may vary slightly as the practitioner so desires to increase or decrease the visual effect of the said present invention. Some ranges are provided here within as a guide to create an increased or decreased visual depth of the said decorative object 1 of the present invention:

A) 0" to 1/32" spacer 5 depth 11 between said first layer 2 and second layer(s) 3=slight to no visual effect.

B) >1/32" to 1/9" spacer 5 depth 11=slight visual effect.

C) >1/9" to ⅛" spacer 5 depth 11=moderate visual effect

D) >⅛" to ¼" spacer 5 depth 11=moderate to good visual effect

E) ¼" spacer 5 depth 11=preferred visual effect

F) >¼" to 1"=undesirable visual effect.

G) 1" to >5"=awkward visual effect.

As shown in FIG. 2 the decorative object 1 as the said invention is a applied to a Poster then the spacer 5 would be a physical object such as but not limited to a piece of ¼" or ¾" foam core with an aperture 6 in the center of the foam core equal to the height and width of the first layer 2 image size. However, the height and width of the spacer's aperture 6 is not a critical dimension in the overall production of the said invention. Preferably the spacer 5 is one solid piece. Although an alternative method of construction would allow the spacer 5 to be individual pieces. As shown in FIG. 4 where more than one transparent image layer is used as the second layer(s) 3, the spacer 5 depth is measured from the first layer 2 to the forward most second layer 3 as the additional transparent layer 3. Thus, the total optimum depth between said layers remains ¼". As shown in FIG. 4 each said transparent image layer is preferably physically separated from the other transparent image layer(s) with a spacer 5 between first layer 2 and any additional transparent image layers 3.

As shown in FIG. 1, the preferred spacer 5 is constructed from a rigid material such as card stock weight paper. The spacer is folded outward to provide a physical separation between the said first layer 2 and said second layer 3. The spacer 5 in this application of the present invention also functions as a place to mount the first layer 2.

Another example of the said spacer 5 is such that the method of attachment from the first layer 2 to the second layer 3 creates a convex relationship between the first layer 2 and the second layer 3. For example, referring to FIG. 6 the decorative object 1 as the said invention is applied to a T-Shirt, the transparent image layer as the second layer 3 may be applied using a sewing technique to "bubble" out the second layer 3 from the first layer 2 creating a convex relationship between said layers where no different physical object from said first layer 2 and second layer 3 is a component of the present invention.

Figure 3:
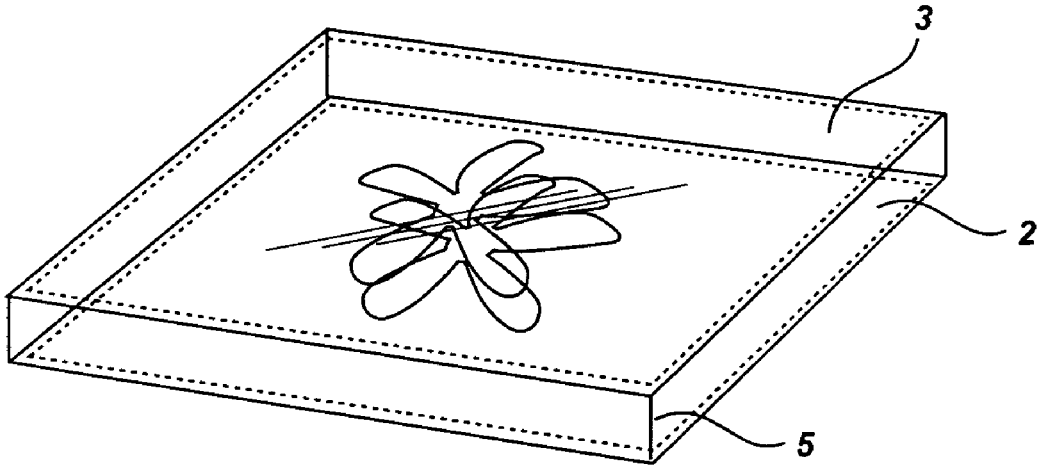

Yet another example of the spacer 5 is shown in FIG. 5 being an application method rather than a physical object is where the decorative object 1 as the present invention is applied to a round object such as a Coffee Mug. The application method in this case allows the second layer 3 to be in convex relation to the first layer 2 through a glass or plastic molding or pliable attachment. Thus, the spacer 5 component of the decorative object 1 as the present invention will also vary in material depending upon end use with same like spatial properties between said first layer 2 and second layer 3 described herein. Appropriate materials for said spacer 5 should be deemed obvious to one skilled in the art of functional product design. For example, the material used for the spacer 5 in the T-shirt example as shown in FIG. 6 as an application method would be thread. Another method application material example is for a coffee mug as shown in FIG. 5 where the second layer 3 (s) are directly applied to a molded glass or plastic to form a convex shape in relation to the said first layer 2. Yet an alternative method of constructing the spacer component for a coaster is shown in FIG. 3 where the spacer is a solid piece of transparent plastic or glass.

Referring to FIG. 1, the next layer to be constructed is the second layer 3 image. It is first important to consider the placement of the second layer 3 in relation to the other components in the present invention. As shown in FIG. 1 and FIG. 2 the second layer 3 image as the transparent layer (s) (upon completion) is placed above and directly on top of the spacer 5 to match the juxtaposition of the first layer 2 image 9. Referring to FIG. 1 the first layer 2 image 9 and second layer 3 image 9 are parallel to one-another. The alignment of the second layer 3 image 9 to the first layer 2 image 9 is such that allows room for off-center registration between the first layer 2 image 9 and second layer(s) 3 image 9. For example if the second layer(s) 3 image 9 is placed off center from the first layer 2 image 9 at 1/32" left or right registered, then the juxtaposition of the first layer 2 image 9 to the second layer 3 image 9 is still considered centered. The practitioner may "eye-ball" the juxtaposition of the second layer 3 image 9 to the first layer 2 image 9 within ½" left, right, up, or down on the parallel plane. The first layer 2 and second layer(s) 3 are thus physically separated from one another by the spacer 5.

When creating the present invention using digital images, placing the second layer(s) 3 image 9 above and on top of the first layer 2 image 9 creates a de-pixelization of the digital images. The de-pixelization refers to an increase in actual pixels and an increase in pixel saturation levels. The purpose of de-pixelization is to create a true image with higher visual clarity reducing distortion within the image(s). Thus, when assigning the dots per inch for either or both the second layer(s) 3 image 9 and the first layer 2 image 9, standard print production settings can be cut in half for the purpose of efficiency. Likewise, if the original image used to create the first layer 2 image 9 is distorted due to a lack of pixels, standard dots per inch settings will aid in the de-pixelization once the decorative object 1 as the present invention is completely constructed as set forth herein. For example: If the DPI (dots per inch) is set at 300 DPI normally, then setting the DPI at 70 DPI for the present invention is called de-pixelization.

As a corollary: the first layer 2 image 9 lays over the second layer 3 image 9 with a separation between the said layers building a physical depth which tricks the eye into seeing saturation thus making the decorative object 1 image appear with increased clarity to the human eye. For example: using a digital imaging and editing software program to set the first layer 2 image at 70 DPI and the second layer 3(s) image at 70 DPI will appear to be a 300 DPI in the final form of the decorative object 1 as the present invention.

Using a digital imaging and editing software program the next step in creating the decorative object 1 as the said present invention is to create the second layer 3(s) as the transparent image layer(s). In the application where there are only two layers being the first layer 2 image 9 and the second layer 3 with no additional transparent image layers, the second layer 3 image 9 is created as an exact copy of the first layer 2 image 9 with exception of optimized color clarity and canvas 10 size. Working from the first layer 2 image 9, the second layer 3 image 9 is optimized for color clarity by fully subtracting the white space and white portions from the first layer 2 image 9. The purpose of this subtraction of white from the first layer 2 image 9 is to create a transparent space in the first layer 2 image 9 where color previously existed. The best method for subtracting color is by choosing the appropriate surface to transfer the decorative image 4 and the appropriate application method.

An appropriate application method for subtracting white space would be a device such as an ink jet printer, or a photocopy machine, or a laser printer as is standard practice to anyone skilled in the art of Graphic Design. The most appropriate surface to transfer the second layer(s) 3 decorative image 4 to is a clear plastic sheet referred to as a "transparency" in the field of Graphic Design.

Another method for subtracting white space from the first layer 2 decorative image 4 is a digital method using a digital image and editing software program. Locating and removing the white space of an image through color adjustment and pixel location is standard practice for anyone who is skilled in Digital Image Manipulation such as a Graphic Artist. Once the white portions of the decorative image 4 have been subtracted, the second layer 3 must be saved as a separate layer from the first layer 2 decorative image 4 (if using a digital image and editing software program).

As stated, the canvas 10 size must also be adjusted from the first layer 2 image 9 in the creation of the second layer 3 image 9 as the transparent image layer. The transparent image layer's canvas 10 size is enlarged within the following parameters:

For the greeting card as the decorative object 1 shown in FIG. 1 the canvas 10 is large enough to provide a space for mounting to the rigid frame front. It is best to construct the canvas 10 at ≧1/32" width and height. The canvas 10 size should not exceed the size of the rigid frame front 8. The optimum size is to have a ½" canvas 10 surround on all sides of the second layer 3 image 9.

The transparent layer is then applied to rigid clear surface using a laser printer, ink jet printer, or photocopy machine. Once the transparent layer is transferred onto the surface as stated, the second layer 3 is complete. The second layer 3 is then placed directly on top of the spacer 5 as stated herein to match the juxtaposition of the first layer 2 image as shown in FIG. 1. Exact placement is desired but a fraction of difference within the placement will not significantly reduce the stated visual effect. The practitioner may "eye-ball" the placement to get the desired effect.

The three layers: the first layer 2, the spacer 5, and the second layer 3 are joined together to form the embodiment of the present invention. Referring to FIG. 1 all layers are joined together in sequential order. Step 1: place the embodiment of the present invention directly onto the rigid frame back 7 as shown in FIG. 1. The rigid frame front 7 is constructed to allow viewing of the embodiment of the present invention. Step 3: affix the rigid frame front 7 and back together to house the embodiment of the present invention. Once each of the stated layers is joined together like a sandwich as set forth, the present invention is complete.

In conclusion of the present example, creating the first layer 2 decorative image 4 and second layer(s) 3 decorative image 4 digitally is preferred as stated herein. The best application and creation of the decorative object 1 of said first layer 2 and second layer(s) 3 is to be determined by the practitioner based upon product end-use. One should consider such factors as aesthetic appeal, cost, ease of production, durability, and overall end-use.

An alternative method of applying the decorative image 4 to the first layer 2 and second layer 3 is through a silk-screening process. Referring to FIG. 3, the coaster has a decorative image 4 that is applied directly to the spacer 5 so that the first layer 2 decorative image 4 and second layer 3 decorative image 4 is embedded onto the spacer 5 through laser application or silk screening. In this example, the first layer 2 decorative image 4 is applied to the bottom side of a solid piece of glass or plastic. The basic principles applied to digital imaging in the previous example also apply to silk screening whereas the first layer 2 decorative image 4 and second layer(s) decorative image 4 are the same with exception of the second layer 3 being free of white space. Constructing the second layer 2 decorative image 4 per the guidelines set forth is deemed readily apparent to one skilled in the art of silk-screening. The first layer 2 decorative image 4 can also be transparent or translucent if the practitioner so desires. As shown in FIG. 3, the decorative image 4 applied to each of the said layers is applied directly to glass or plastic.

The glass or plastic acts as the spacer 5 that physically separates the first and second layer (s) 3. As shown in FIG. 3 the first layer 2 is applied to the back side of the plastic or glass while the second layer 3 is free of white space and applied to the front side of the glass or plastic. Where the method of silk-screening is used the rigid frame front 8 and rigid frame back 7 may be a clear protective coating such but not limited to a spray lacquer, or a "brushed on polyurethane". An alternative rigid frame front 8 and rigid frame back 7 is a piece of glass or plastic material. The purpose of the rigid frame front 7 and the rigid frame back 8 is to protect the decorative image 4.

Further shown in FIG. 3, the juxtaposition of the first layer 2 and the second layer 3 and the spacer 5 is consistent with the juxtaposition principles in each preferred embodiment stated herein.

Alternative materials used to construct the present invention are shown in FIG. 6 where the material used to display the decorative image 4 for the first layer 2 is a T-shirt material such as cloth and the white space as mentioned herein would refer to any space that is opaque. The material used for the second layer 3 is a transparent cloth or pliable and washable plastic.

Same like application (s) parameters as discussed herein for the preferred embodiments illustrated in FIG. 1 through FIG. 5 apply to the embodiment shown in FIG. 6. Alternative methods of application of first layer 2 decorative image 4, and second layer 3 decorative image 4 are as follows: heat transfer, laser imprint, paint, and or stained glass application. The appropriate application method of the decorative image 4 to the first layer 2 and second layer 3 is deemed readily apparent to one skilled in the art of functional product design.

The size, and shape of the decorative object is not significant in achieving the present invention with exception of Digital Imaging as an application method for the first layer 2 decorative image 4 and the second layer 3 decorative image 4 as discussed herein.

While the invention has been described in connection with a preferred embodiments, such description is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A versatile decorative object having a multidimensional visual effect comprising a first layer separated from a second layer wherein the first layer is opaque and has applied on it a decorative image having at least black and white and wherein the second layer is transparent and has applied on it the same decorative image with the white of the image on the second layer being transparent with no color.

2. The versatile decorative object as claimed in claim 1, wherein the second layer is juxtaposed over the first layer so that the images in the two layers are in approximate alignment.

3. The versatile decorative object as claimed in claim 2, wherein the first layer to the second layer registration lines up the images at no greater than ½" and no less than 0" horizontal alignment from said first layer and second layer.

4. The versatile decorative object as claimed in claim 1 wherein the decorative image applied to the first and second layers includes at least one color.

5. The versatile decorative object as claimed in claim 1 wherein the decorative image applied to the second layer differs from the same image as applied to the first layer with respect to one or more of the following: color composition, contrast, color saturation and dimensional distortion.

6. The versatile decorative object as claimed in claim 1 wherein the decorative image applied to the first layer is no more than 25% larger or 25% smaller than the same image applied to the second layer.

7. The versatile decorative object as claimed in claim 1 wherein the decorative image applied to the second layer is applied as a lower quality image than as applied to the first layer.

8. The versatile decorative object as claimed in claim 1 wherein the decorative image applied to the first and second layers is digitally created.

9. The versatile decorative object as claimed in claim 1 further comprising a separation means to separate the first layer from the second layer.

10. The versatile decorative object as claimed in claim 9 wherein separation means the first and second layers comprises an inner layer mat that is one solid piece with an aperture in the center sized to match the decorative image size.

11. The versatile decorative object as claimed in claim 9 wherein said separation means is a direct attachment of the first and second layer with the second layer being in convex relationship to the first layer.

12. The versatile decorative object as claimed in claim 9 wherein said separation means is a rigid spacer placed between the said first and second layer.

13. The versatile decorative object as claimed in claim 12, wherein said spacer comprises a physical object separating the said first layer and said second layer at a distance that is no greater than 3" and smaller than 1/32".

14. The versatile decorative object as claimed in claim 1 further comprising at least one additional transparent layer separated from the first layer and second layer and having the same decorative image applied to it wherein said decorative image has at least black and white on each of said additional layers.

15. The versatile decorative object as claimed in claim 14 wherein the same decorative image as applied to each additional transparent differs with differing in level of opacity, color composition, dimensional distortion, and/or color separations.

16. The versatile decorative object as claimed in claim 14 further comprising a means to separate each of the additional transparent layers from one another.

17. The versatile decorative object as claimed in claim 1 further comprising a rigid frame back and a rigid frame front.

* * * * *